US007867007B2

(12) United States Patent
Szu

(10) Patent No.: US 7,867,007 B2
(45) Date of Patent: Jan. 11, 2011

(54) PGA CONTACT WITH INCLINED FLEXIBLE ARM

(75) Inventor: Ming-Lun Szu, Tu-Cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/547,512

(22) Filed: Aug. 26, 2009

(65) Prior Publication Data

US 2010/0055997 A1 Mar. 4, 2010

(30) Foreign Application Priority Data

Aug. 26, 2008 (TW) ..... 97215279

(51) Int. Cl.
*H01R 4/50* (2006.01)

(52) U.S. Cl. ..... 439/342; 439/857

(58) Field of Classification Search ..... 439/342, 439/856, 857

See application file for complete search history.

(56) References Cited

U.S. PATENT DOCUMENTS 2,468,368 A * 4/1949 Jackson ..... 439/857
2,539,230 A * 1/1951 Craig ..... 439/733.1
3,989,331 A * 11/1976 Hanlon ..... 439/70
6,056,576 A * 5/2000 Szu ..... 439/342
6,113,411 A 9/2000 Lu et al.
6,371,784 B1 * 4/2002 Scholz et al. ..... 439/342
6,478,598 B1 * 11/2002 Szu ..... 439/342
6,554,634 B1 * 4/2003 Lin et al. ..... 439/342
6,979,219 B2 * 12/2005 Scholz ..... 439/342
7,303,421 B2 * 12/2007 Liao ..... 439/342
7,727,032 B2 * 6/2010 Szu ..... 439/857
2010/0055997 A1 * 3/2010 Szu ..... 439/861

* cited by examiner

*Primary Examiner*—James Harvey
(74) *Attorney, Agent, or Firm*—Andrew C. Cheng; Wei Te Chung; Ming Chieh Chang

(57) ABSTRACT

An electrical contact for electrically connecting with a pin of an electrical package, includes a base portion as a planar board-like, a first and a second mating fingers jointly configuring a room for receiving the pin, and a flexible arm being inclined relative to the base portion and connecting with the base portion and one of the first with the second mating fingers.

10 Claims, 4 Drawing Sheets

PGA CONTACT WITH INCLINED FLEXIBLE ARM

BACKGROUND OF THE INVENTION

1. Field of the Invention

The present invention relates to an electrical contact, and more particularly to a contact having engaging portion offset from a base portion by an inclined and flexible arm such that the contact engaging portion is aligned with a mounting portion thereof.

2. Description of the Prior Art

U.S. Pat. No. 6,113,411 issued to Lu on Sep. 5, 2000 discloses a contact used in a socket for electrically connecting with a pin of a chipset. The contact comprises a fixing portion for being fixed in the socket, a mating portion and a connecting portion connecting the fixing portion and the mating portion. The mating portion has a receiving portion which forms a receiving space adapted for entrance of the pin of the chipset to be in a first position, and has two engaging portions extending from the receiving portion for sidewardly gripping the pin of the chipset therebetween when the pin of the chipset is moved from the first position to a second position. However, the mating portion and the connecting portion are positioned in a vertical direction and are coplanar with the fixing portion, that may limit a deformation of the mating portion.

Referring to FIG. 1, a conventional contact 10 is used for electrically connecting pin grad array (PGA) package and a printed circuit board. The contact comprises a planar retention portion 11, a soldering portion 12 extending from the retention potion 11 and substantially perpendicular to the retention portion 11, and a pair of spring arms 13 extending upwardly from two opposite sides of the retention portion 11. The spring arms 13 are disposed symmetrically, and the pin of the PGA package is inserted into a room defined between the spring arms 13. However, the contact 10 is symmetric and complicated so that it occupies a large room of a passageway of an insulative housing for receiving the contact 10 and wastes much metallic material. In order to cost down and reduce a size of the contact, it is needed to find an improved contact to overcome the problems mentioned above.

SUMMARY OF THE INVENTION

Accordingly, an object of the present invention is to provide an electrical contact having a flexible arm for reducing a size of the contact.

In order to achieve the object set forth, an electrical contact, comprises a base portion located in a vertical plane, a flexible arm extending from the base portion and located in an inclined second plane relative to the first plane, and a mating arm disposed at a free end of the flexible arm and being formed with a first mating finger and a second mating finger faced to the first mating finger.

In order to further achieve the object set forth, an electrical contact for electrically connecting with a pin of an electrical package comprises a base portion in a planar board, a first and a second mating fingers jointly configuring a room for receiving the pin, and a flexible arm being inclined relative to the base portion and connecting the base portion with one of the first and the second mating fingers.

DESCRIPTION OF PREFERRED EMBODIMENT

Reference will now be made to the drawings to describe the present invention in detail.

Figure 1:
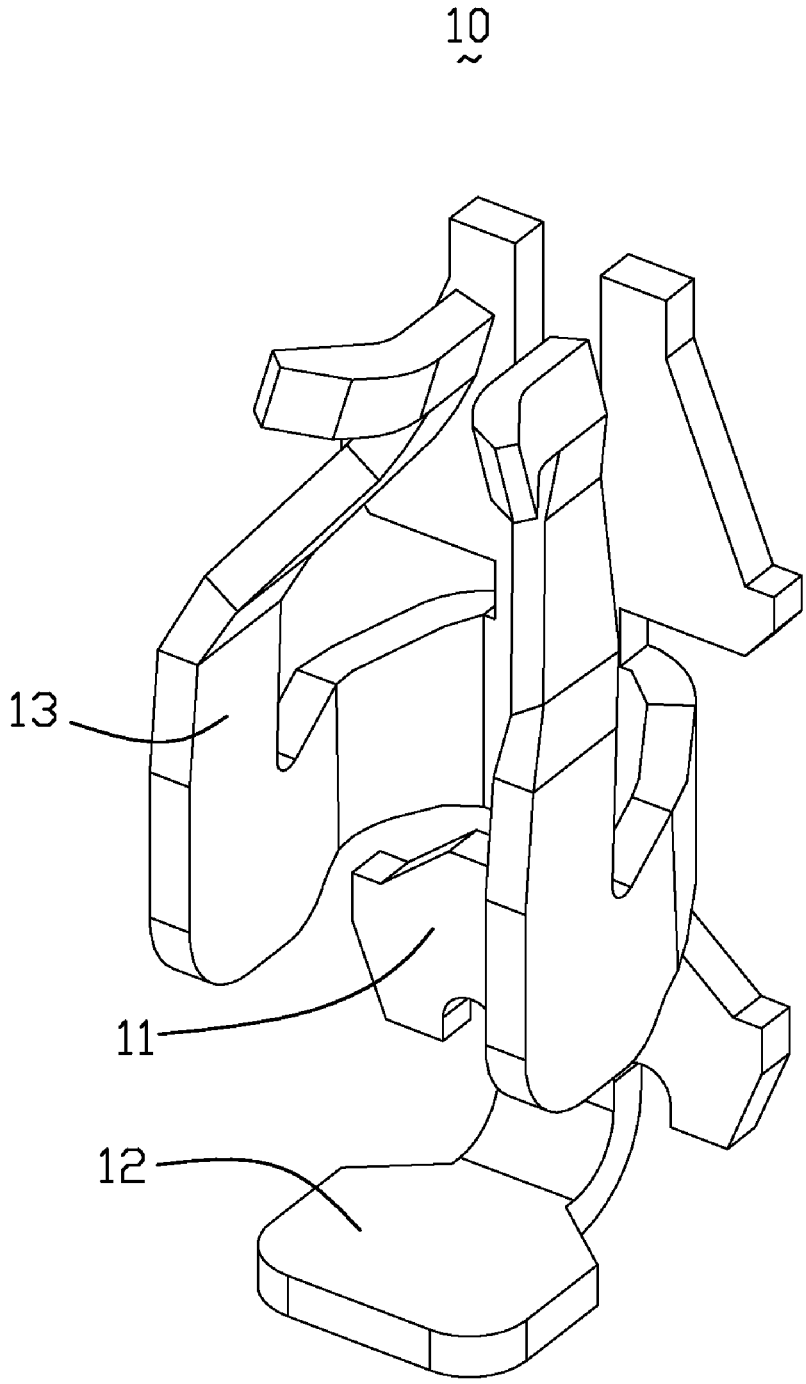
FIG. 1 (PRIOR ART)
FIG. 1 is a perspective view of a conventional contact.
Figure 2:
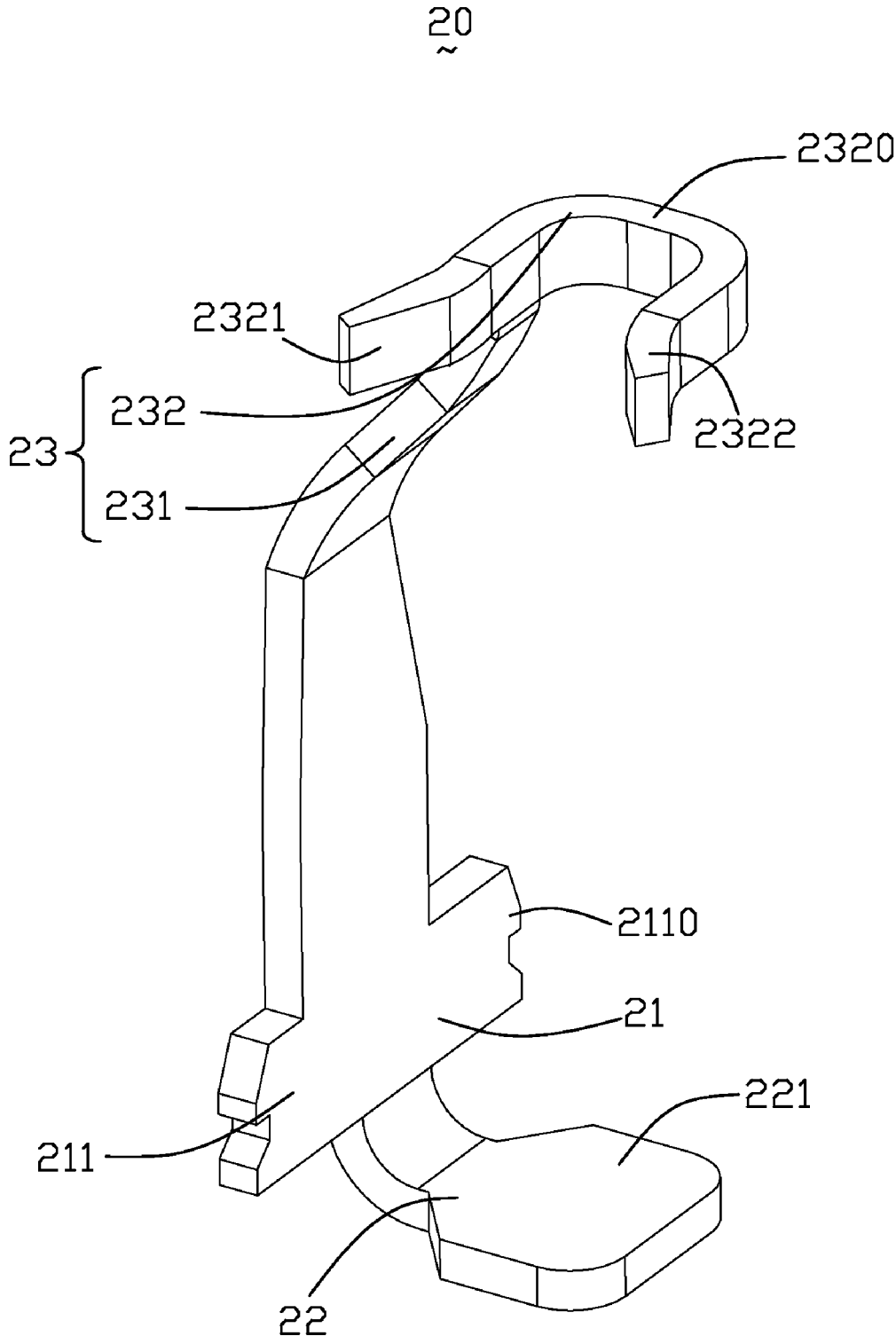
FIG. 2 is a perspective view of a contact in accordance with the present invention.

FIG. 2 show a contact 20 adapted to assembled within an insulative housing (not shown) and establishing an electrical connection between a pin grad array (PGA) package (not shown) and a printed circuit board (not shown). The contact 20 comprises a base portion 21, a tail portion 22 extending from the base portion 21, and a spring arm 23 extending upwardly from the base portion 21.

The base portion 21 is positioned in a first plane and extending along a vertical direction. A retention portion 210 is located at a lower region of the base portion 21 and extends laterally. A plurality of barbs 2110 are provided on two opposite sides of the retention portion 210, adapted for securing the contact 20 in the insulative housing (not shown).

The tail portion 22 is used to nest a solder ball to interconnect with the printed circuit board (not shown). In the present embodiment, the tail portion 22 extends from a bottom edge of the base portion 21 and is formed with a horizontal soldering plane 221. The soldering plane 221 is substantially vertical to the base portion 21. Alternatively, the tail portion 22 also can extend downwardly from the base portion 21 as a pin leg inserted into the printed circuit board (not shown).

Figure 3:
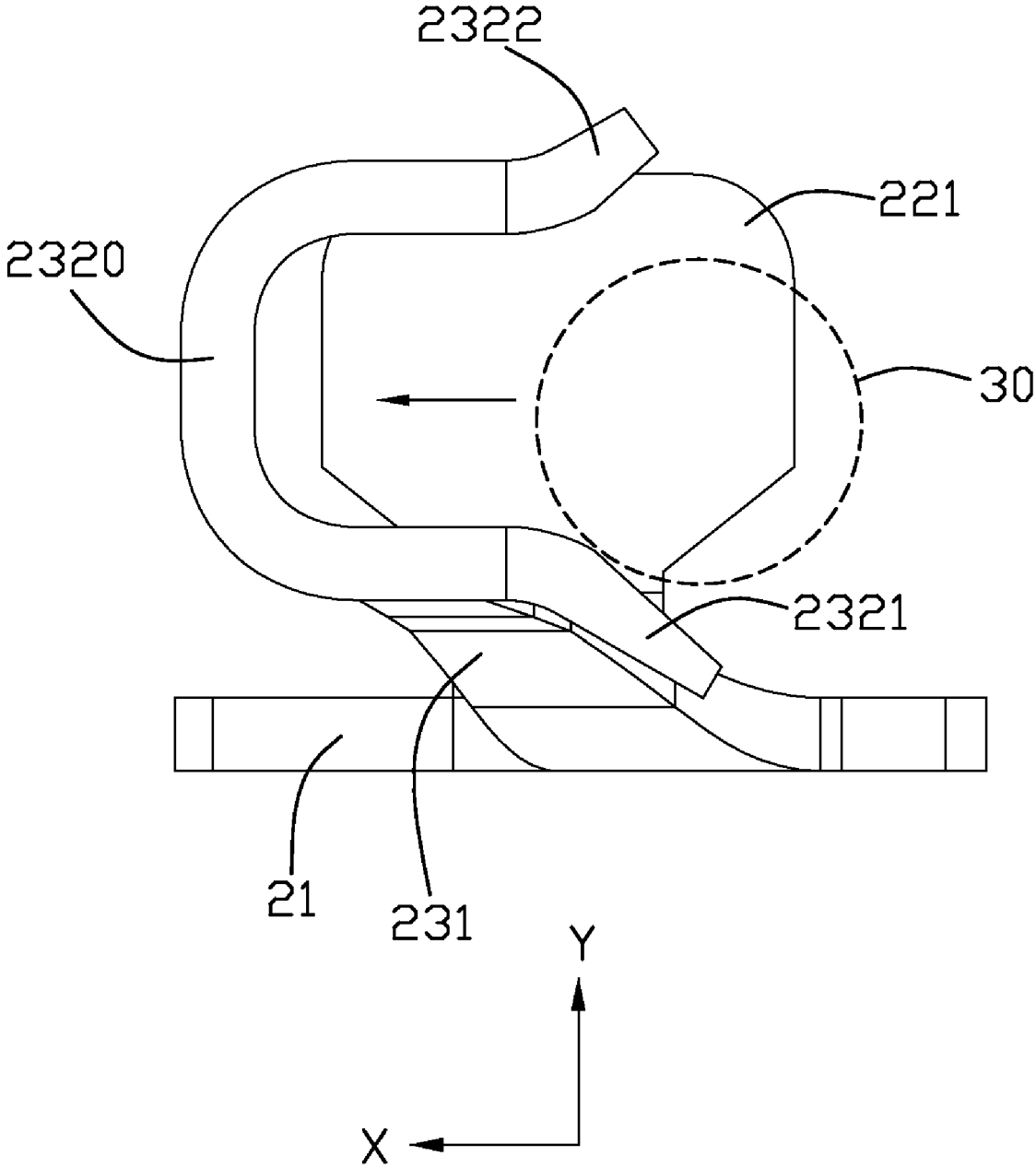
FIG. 3 is a top view of the contact of FIG. 2.
Figure 4:
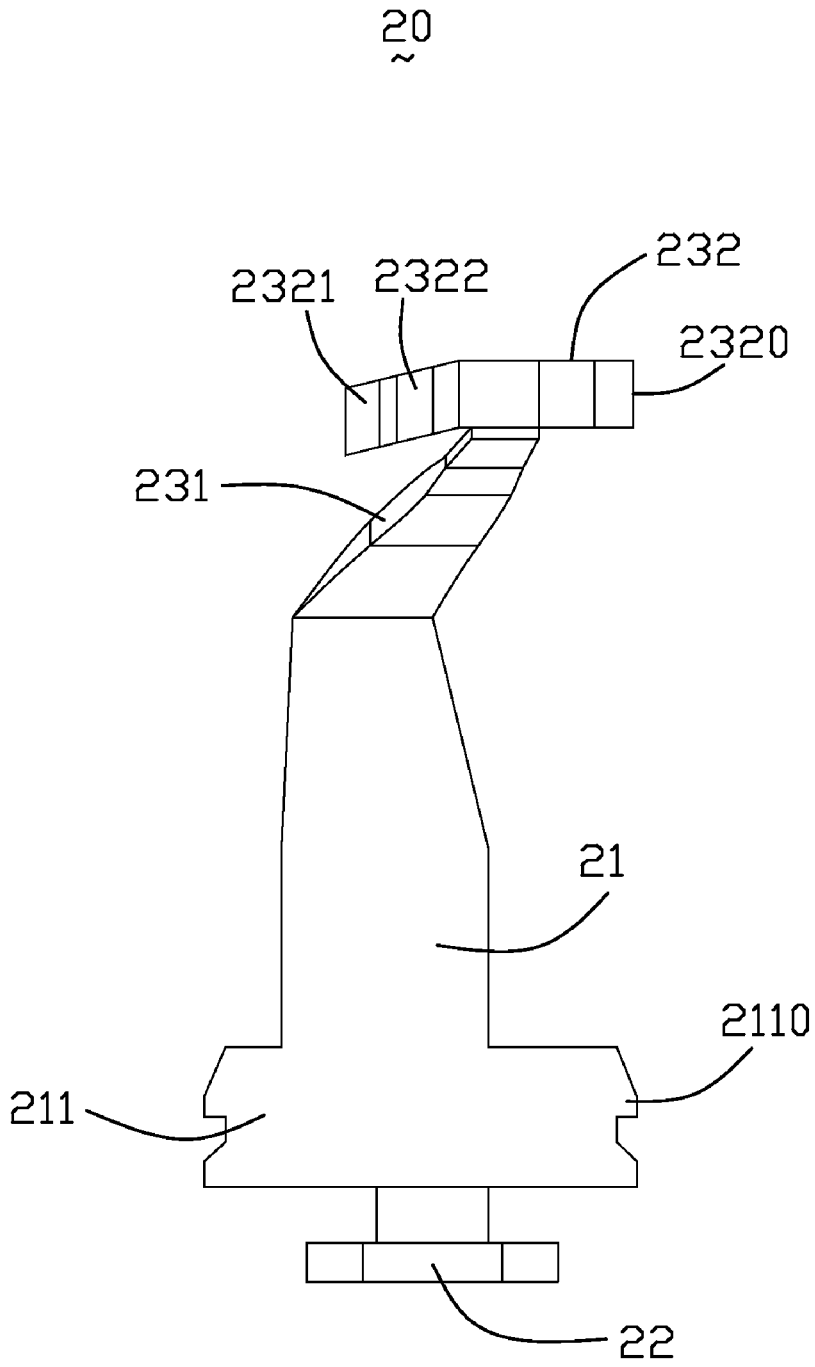
FIG. 4 is a side view of the contact of FIG. 2.

Referring to FIG. 2 to FIG. 4, the spring arm 23 comprises a flexible arm 231 extending upwardly and aslant from the base portion 21 and a mating arm 232 disposed on a top end of the flexible arm 231. The flexible arm 231 extends from the base portion 21 both toward an X direction and a Y direction perpendicular to the X direction in a horizontal surface so that the flexible arm 231 is located in an inclined second plane relative to the first plane which the base portion 21 is located. The mating arm 232 is substantially formed with a U-shaped configuration and disposed in a horizontal plane. The mating arm 232 comprises a first mating finger 2321, a second mating finger 2322, and a linking portion 2320 connecting with the first mating finger 2321 and the second mating finger 2322. The first mating finger 2321 and the second mating finger 2322 are opened outwardly for leading a pin 30 of the electronic package (not shown) into the U-shape area to establish an electrical connection between the contact 20 and the electronic package (not shown). In addition, the first mating finger 2321 is longer than the second mating finger 2322, and the flexible arm 231 connects with the first mating finger 2321.

FIG. 3 shows a top view of the pin 30 of electronic package (not shown) inserting into the mating arm 232. When the pin 30 is moved along a direction as marked by the arrow and which is same with the X direction, the pin 30 firstly contacts with the first mating finger 2321, and then contacts with both the first and the second mating fingers 2321, 2322. During the engaging process, the pin 30 pushes the mating fingers 2321, 2322 moving in the horizontal plane, and in the meantime, the flexible arm 231 moves outwardly toward the base portion 21. Because the contact 20 has one inclined flexible arm 231 and the substantially U-shaped mating arm 232 disposed on the flexible arm 231, the contact 20 has a small size and a simplified structure for receiving the pin 30 of the electronic package (not shown).

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical contact, comprising:

a base portion located in a vertical first plane;

a flexible arm extending from the base portion and located in an inclined second plane relative to the first plane; and a mating arm disposed at a free end of the flexible arm and being formed with a first mating finger and a second mating finger faced to the first mating finger;

wherein the flexible arm extends upwardly from the base portion, and the mating arm is disposed in a horizontal plane;

wherein the mating arm includes a linking portion connecting with the first finger and the second mating finger;

wherein the first and the second mating fingers are opened outwardly, and the first mating finger is longer than the second mating finger.

2. The electrical contact as claimed in claim 1, wherein the flexible arm connects with the first mating finger.

3. The electrical contact as claimed in claim 2, wherein a tail portion extends from the base portion and has a soldering plane perpendicular to the base portion.

4. The electrical contact as claimed in claim 3, wherein a retention portion is located at a lower region of the base portion and extends laterally, and a plurality of barbs are disposed on two opposite sides of the retention portion.

5. The electrical contact as claimed in claim 4, wherein the base portion does not extend from a center area of an upper edge of the retention portion.

6. An electrical contact for electrically connecting with a pin of an electrical package, comprising:

a base portion being in a planar board;

a first and a second mating fingers jointly configuring a room for receiving the pin; and a flexible arm being inclined relative to the base portion and connecting the base portion with one of the first and the second mating fingers;

wherein the first and the second mating fingers are connected by a linking portion and expand outwardly for leading the pin of the electronic package;

wherein the first mating finger is longer than the second mating finger and connects with the flexible arm.

7. The electrical contact as claimed in claim 6, wherein the first mating finger firstly contacts with the pin during the pin moving into the room, and the second mating finger contacts with the pin later.

8. The electrical contact as claimed in claim 7, wherein during the inserting process, the pin pushes the mating fingers to move in a horizontal plane and the flexible arm to move outwardly toward the base portion.

9. The electrical contact as claimed in claim 8, wherein the pin moves into a space between the mating fingers.

10. The electrical contact terminal as recited in claim 1, further comprising a mounting portion substantially in align with a center defined by the first and second mating fingers.

* * * * *